US007225570B2

(12) United States Patent
Windorski

(10) Patent No.: US 7,225,570 B2
(45) Date of Patent: Jun. 5, 2007

(54) FOLD-OVER TABBED NOTES AND FLAGS

(76) Inventor: David C. Windorski, P.O. Box 33427, St. Paul, MN (US) 55133-3427

( * ) Notice: Subject to any disclaimer, the term of this patent is extended or adjusted under 35 U.S.C. 154(b) by 0 days.

(21) Appl. No.: 10/884,046

(22) Filed: Jul. 2, 2004

(65) Prior Publication Data

US 2006/0000134 A1 Jan. 5, 2006

(51) Int. Cl.
*B42F 21/04* (2006.01)

(52) U.S. Cl. ..... 40/641; 40/359; 283/26

(58) Field of Classification Search ..... 40/360, 40/630, 640; 116/234–239; 281/44; 283/36–44; D19/34
See application file for complete search history.

(56) References Cited

U.S. PATENT DOCUMENTS

| | | | | | |
|---|---|---|---|---|---|
| 399,417 | A | * | 3/1889 | Lane | 116/236 |
| 1,584,238 | A | * | 5/1926 | Menger | 40/360 |
| 2,081,095 | A | | 5/1937 | Mull | |
| 3,458,948 | A | | 8/1969 | Lasswell | |
| 3,552,047 | A | | 1/1971 | Dalziel | |
| 3,604,067 | A | * | 9/1971 | Brown | 24/67 R |
| 4,041,575 | A | | 8/1977 | MacArthur | |
| 4,143,477 | A | * | 3/1979 | Reynolds | 40/359 |
| 4,232,461 | A | | 11/1980 | Crawford et al. | |
| 4,477,048 | A | | 10/1984 | Conway | |
| 4,572,380 | A | | 2/1986 | Langwell | |
| 4,693,441 | A | | 9/1987 | Conway | |
| 4,770,320 | A | | 9/1988 | Miles et al. | |
| 4,781,306 | A | | 11/1988 | Smith | |
| 4,907,825 | A | | 3/1990 | Miles et al. | |
| 5,287,823 | A | | 2/1994 | Jiang | |
| 5,423,436 | A | | 6/1995 | Morrow | |
| 5,495,644 | A | | 3/1996 | Mesher et al. | |
| 5,683,194 | A | | 11/1997 | Emmel et al. | |
| 5,707,032 | A | * | 1/1998 | Ehrlich | 248/205.3 |
| 5,769,270 | A | | 6/1998 | Fujisawa et al. | |
| 5,806,222 | A | * | 9/1998 | Shaffer | 40/638 |
| 5,870,802 | A | | 2/1999 | Goldman | |
| 5,876,817 | A | | 3/1999 | Mathna et al. | |

(Continued)

FOREIGN PATENT DOCUMENTS

DE 3341248 5/1985

(Continued)

OTHER PUBLICATIONS

U.S. Appl. No. 10/884,045; Windorski, David C.; Tabbed Notes and Flags; filed on Jul. 2, 2004.

(Continued)

*Primary Examiner*—Cassandra Davis

(57) ABSTRACT

A tab for attaching to sheet material comprises a substrate including a front side, a back side opposite the front side, an upper portion, a middle portion, and a lower portion. The tab includes a cut through the middle portion of the substrate to form a flap, an adhesive along the upper portion of the back side and along the lower portion of the back side of the substrate, and a fold-line through the middle portion which allows the substrate to be folded. When the substrate is folded along the fold-line, the flap extends beyond the fold-line and the back side of the upper portion faces the back side of the middle portion.

20 Claims, 3 Drawing Sheets

U.S. PATENT DOCUMENTS

| | | | | |
|---|---|---|---|---|
| 5,967,561 | A * | 10/1999 | Glenn | 283/81 |
| 6,090,461 | A | 7/2000 | Frank et al. | |
| 6,360,466 | B1 * | 3/2002 | Thomas, III | 40/638 |

FOREIGN PATENT DOCUMENTS

| | | |
|---|---|---|
| DE | 38 36 615 | 5/1990 |
| DE | 296 01 982 | 6/1997 |
| DE | 19704211 | 8/1998 |
| FR | 2 460 793 | 1/1981 |
| FR | 2666386 | 3/1992 |
| GB | 103237 | 1/1917 |
| GB | 2298890 | 9/1996 |
| JP | 05 050782 | 3/1993 |
| JP | 1999-82467 | 3/1999 |
| JP | 2001-191672 | 7/2001 |
| JP | 2002-130243 | 5/2002 |
| JP | 2002-264573 | 9/2002 |
| SE | 7902776 | 9/1980 |
| WO | WO 89/06602 | 7/1989 |
| WO | WO 91/05321 | 4/1991 |
| WO | WO 93/20547 A * | 10/1993 |

OTHER PUBLICATIONS

U.S. Appl. No. 10/859,395; Kitchin, et al.; Adhesive Clip Assembly; filed on Jun. 2, 2004.

* cited by examiner

FOLD-OVER TABBED NOTES AND FLAGS

BACKGROUND OF THE INVENTION

The present invention relates to an adhesive planar article. More specifically, the present invention relates to an adhesive coated planar article having a cut-out flap and an upper portion that is folded to form a tab extension when the adhesive coated planar article is attached to sheet material.

In working with large stacks of documents, it is often desirable to categorize the documents or to flag a document that is of particular importance. Tabs are useful to categorize documents by signaling when one category ends and another begins or to highlight a page of particular importance. In addition to flagging a page, it is often desirable to also make notes on that page. However, depending on the importance of maintaining the original document, marking directly on the flagged page may not be desirable.

To flag a page of paper from a stack or binder of papers, typically a separate tab page is inserted into the binder or an adhesive backed paper is attached to the flagged paper. Adding a separate tab page adds to the bulk of the stack of papers. Further, a separate tab page does not allow notes to be placed in direct connection to a document because the tab page precedes the related documents.

Using an adhesive backed paper to flag a page can be useful in flagging the page and providing a writing surface. However, the use of an adhesive note such as a 3M Post-it® brand note for this purpose may not properly align the note with the flagged paper, resulting in nonuniform tabs extending from the page (e.g., tabs of different lengths, tilted tabs, etc.). Marked documents with nonuniform tabs may make the collection of papers appear unorganized and unprofessional.

BRIEF SUMMARY

A tab for attaching to sheet material comprises a substrate including a front side, a back side opposite the front side, an upper portion, a middle portion, and a lower portion. The tab includes a cut through the middle portion of the substrate to form a flap, an adhesive along the upper portion of the back side and along the lower portion of the back side of the substrate, and a fold-line through the middle portion which allows the substrate to be folded. When the substrate is folded along the fold-line, the flap extends beyond the fold-line and the back side of the upper portion faces the back side of the middle portion.

While the above-identified figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the spirit and scope of the principals of this invention. The figures may not be drawn to scale. Like reference numbers have been used throughout the figures to denote like parts.

DETAILED DESCRIPTION

Figure 1:
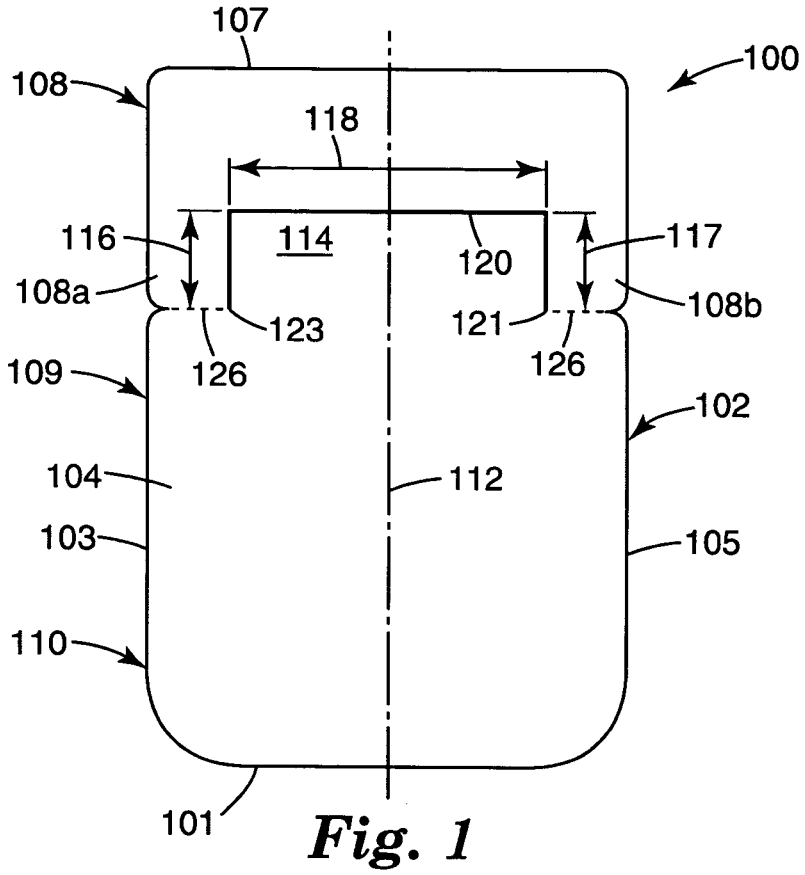
FIG. 1 is a plan view of a front side of a tab of the present invention.
Figure 2:
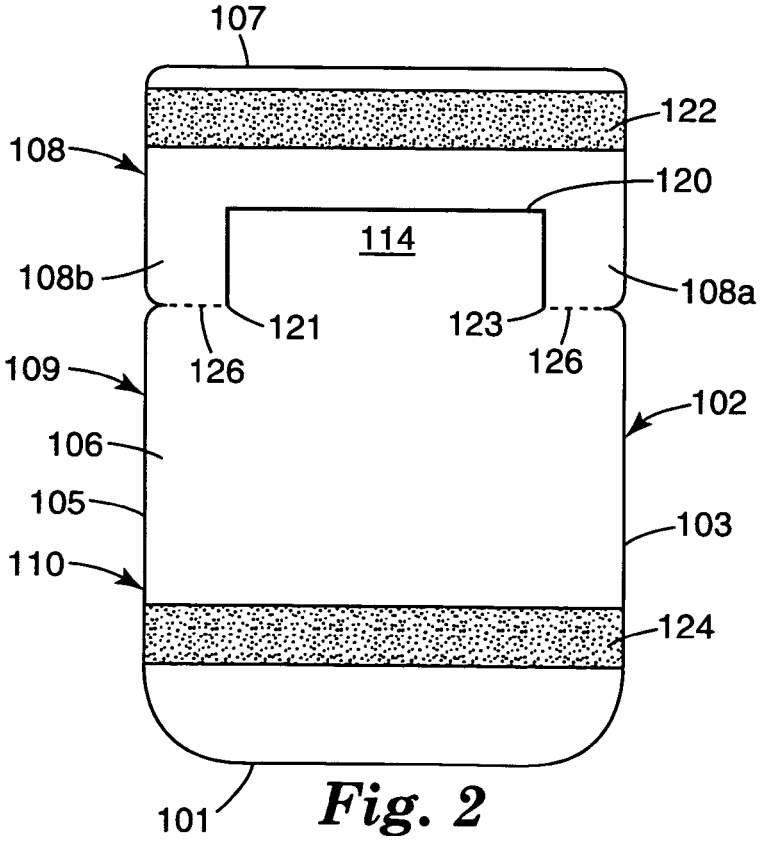
FIG. 2 is a plan view of a back side of the tab.

FIG. 1 is a plan view of a front side 104 of a tab 100. The tab 100 comprises a substrate 102 having an internal cut 120 therethrough. The substrate 102 can be paper, card stock paper, thin-film plastic or any similar type of flexible material. The substrate 102 has a lower edge 101, a first side edge 103, a second side edge 105, and an upper edge 107. The substrate 102 has an upper portion 108, a middle portion 109, and a lower portion 110. The substrate 102 has a front side 104 and a back side 106, as shown in FIG. 2.

The substrate 102 in the embodiment shown in FIG. 1 is generally rectangular shaped with rounded edges and is generally symmetrical about a longitudinal axis 112 extending through the upper portion 108, middle portion 109, and lower portion 110. However, in other embodiments, the substrate 102 can be asymmetrical about a longitudinal axis 112. The radius of each of the rounded edges at the upper portion 108 is smaller than the radius of each of the rounded edges at the lower portion 110 to provide a visual and tactile signal to the user relative to the top and bottom of the tab 100.

The cut 120 is through the middle portion 109 of the substrate 102. The cut has a first end 121 and a second end 123. Overall, the cut 120 has a width 118, a first length 116, and a second length 117. The cut 120 is shown as being symmetrical or a mirror-image about the longitudinal axis 112, so that the portion of the width 118 and the length 116 and 117 of the cut 120 on each side of the longitudinal axis 112 are the same. The cut 120 is shown as an inverted U-shape but may be any suitable shape for forming a page marking tab having a desired shape.

The cut 120 through the substrate 102 forms a flap 114. When the first length 116 and the second length 117 are equal and a line passing between the first end 121 and second end 123 is perpendicular to the longitudinal axis 112, then the flap 114, which is ultimately a tab extension 136 (see FIG. 4–6), will be properly and repeatably aligned with a sheet of paper 130.

A crease or fold-line 126 is formed, which allows the upper potion 108 of the substrate 102 to fold relative to the middle portion 109 and lower portion 110. The fold-line 126 extends on either side of the cut 120 and is adjacent to the first end 121 and second end 123 of the cut 120. The fold-line 126 is substantially perpendicular to the longitudinal axis 112 and passes through the first end 121 and second end 123 of the cut 120.

FIG. 2 is a plan view of the back side 106 of the tab 100. A first adhesive band or strip 122 is disposed on the back side 106 of the upper portion 108 of the substrate 102 and extends from the first side edge 103 to the second side edge 105 of the substrate 102. The first adhesive strip 122 is spaced from the upper edge 107 of the substrate 102 to aid in handling the tab 100. A second adhesive band or strip 124 is disposed on the back side 106 of the lower portion 110 of the substrate 102 and extends from the first side edge 103 to the second side edge 105 of the substrate 102. The second adhesive strip 124 is spaced from the lower edge 101 of the substrate 102 to aid in handling the tab 100. The middle portion 109 is free of adhesive.

The first adhesive strip 122 and second adhesive strip 124 may be a permanent adhesive or any suitable pressure sensitive adhesive or repositionable pressure sensitive adhesive such as the repositionable pressure sensitive adhesives used on Post-its notes, manufactured by 3M Company, St. Paul, Minn. Exemplary repositionable pressure sensitive adhesives comprising solid microspheres are described in U.S. Pat. No. 5,571,617 (Cooprider, et al.) and U.S. Pat. No. 5,824,748 (Kesti, et al.). Other pressure sensitive adhesives can also be used. While any adhesive can be used, the preferred adhesive for the current invention is a repositionable type, making tab 100 "repositionable" itself.

Figure 3:
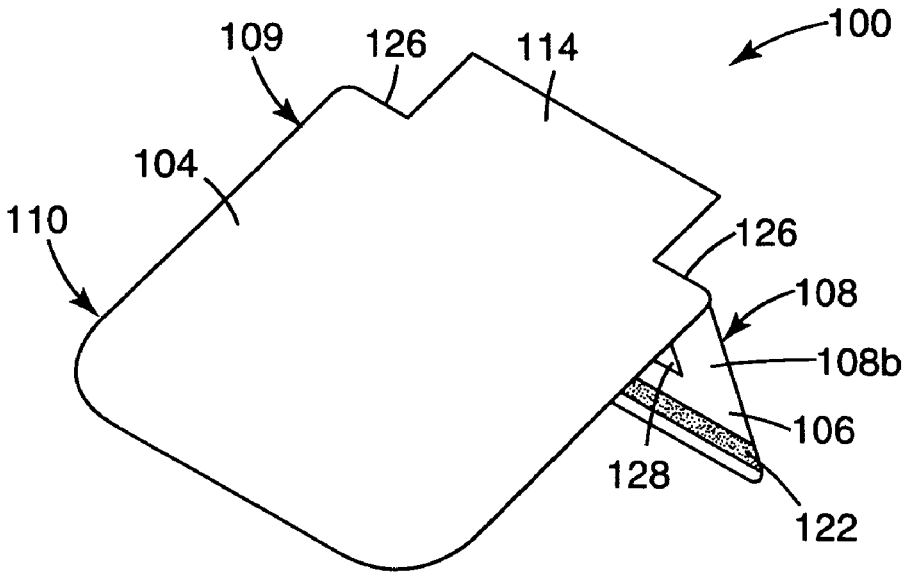
FIG. 3 is a perspective view of the tab.

FIG. 3 is a perspective view of the tab 100 in a partially folded state. The tab 100 is constructed of a flexible material so that the upper portion 108, which includes side bar portions 108*a* and 108*b*, which extend laterally beyond the flap 114, is capable of bending along the fold-line 126 relative to the lower portion 110 and middle portion 109, which includes the flap 114. Typically, the upper portion 108 will be folded such that the back side 106 of the upper portion 108 will face the back side 106 of the middle portion 109 and lower portion 110. When the upper portion 108 is folded back, the flap 114 continues to extend along the same plane as the front side 104, and an opening 128 is formed through the upper portion 108 between the side bar portions 108*a* and 108*b* where the flap 114 is missing.

Figure 4:
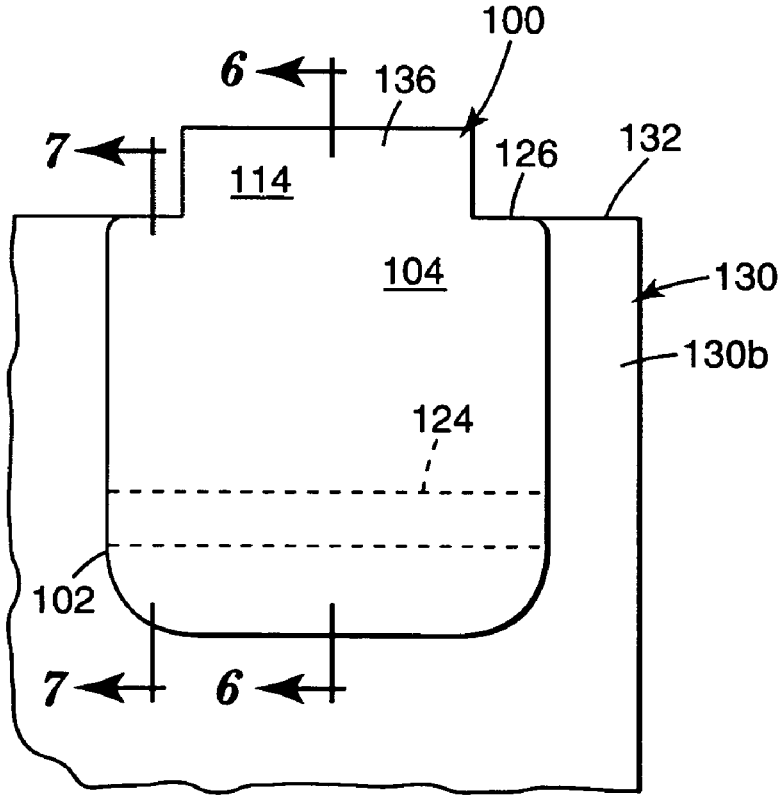
FIG. 4 is a plan view of the front side of the tab engaged with a sheet of paper.
Figure 5:
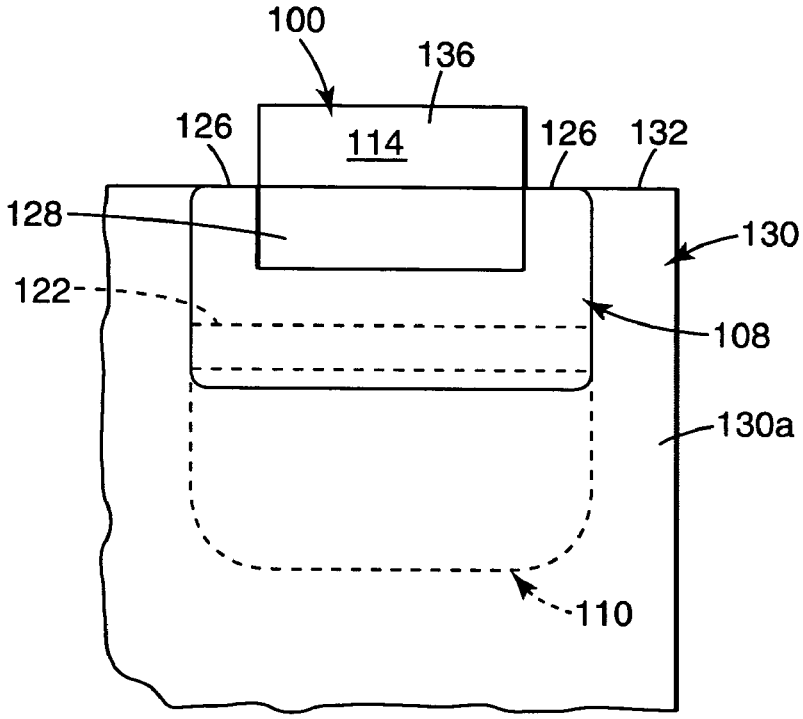
FIG. 5 is a plan view of the back side of the tab engaged with a sheet of paper.

FIG. 4 is a plan view of the front side 104 of the tab 100 engaged with a sheet of paper 130 to form a tab extension 136. The sheet of paper 130 has a top edge 132 that is positioned between the back side 106 of the folded upper portion 108, see FIG. 3, and the back side 106 of the middle portion 109 and lower portion 110. The top edge 132 of the sheet of paper 130 abuts against the fold-line 126. Because the fold-line 126 is substantially parallel to the top edge 132 of the sheet of paper 130, when the sheet of paper 130 abuts against the fold-line 126, the tab 100 aligns uniformly with the top edge 132 of the sheet of paper 130. Therefore, so long as the top edge 132 of the sheet of paper 130 is in abutting relation with the fold-line 126 on both sides of the flap 114, (as shown in FIGS. 4 and 5) the tab extension 136 will always extend in a uniform manner and distance from the top edge 132 of the sheet of paper 130. It should be noted that while use of tab 100 on a sheet of paper is described and illustrated throughout the specification, any number of uses on any sheet material (or multiple sheets of sheet material) is contemplated by the current invention.

When the tab 100 is attached to a sheet of paper 130, the first adhesive strip 122 on the upper portion 108 of the back side 106 of the substrate 102 is adhered to a first side 130*a* of the sheet of paper 130. The second adhesive strip 124 on the lower portion 110 of the back side 106 of the substrate 102 is adhered to a second side 130*b* of the sheet of paper 130, opposite the first side 130*a*. The back side 106 of the substrate 102 is opposite the front side 104 and is shown in FIG. 2, and except for the flap 114, all of the back side 106 is placed in contact with the sheet of paper 130 either on its first side 130*a* or on its second side 130*b*. The first adhesive strip 122 secures the upper portion 108 of the tab 100 to the sheet of paper 130, and the second adhesive strip 124 secures the lower portion 110 of the tab 100 to the sheet of paper 130.

When the upper portion 108 is folded over the sheet of paper 130 and the flap 114 continues to extend in the plane along the front side 104, the flap forms a tab extension 136. The tab extension 136 is the portion of the tab 100 extending beyond the top edge 132 of the sheet of paper 130. The tab extension 136 shown is generally rectangular shaped, however the tab extension 136 may be any shape so long as it is capable of extending beyond the top edge 132 of the sheet of paper 130.

FIG. 5 is a plan view of the back side 106 of the tab 100 engaged with a sheet of paper 130. As can be seen, the upper portion 108 is folded at the fold-line 132 over the sheet of paper 130. Therefore, the back side 106 of the upper portion 108 faces the back side 106 of the middle portion 109 and lower portion 110. The first adhesive strip 122 and second adhesive strip 124 are in contact with the sheet of paper 130 to hold the tab 100 in place relative to the sheet of paper 130. The sheet of paper 130 is exposed through the opening 128, which is the cut-out of the flap 114, which is now serving as the tab extension 36.

Figure 6:
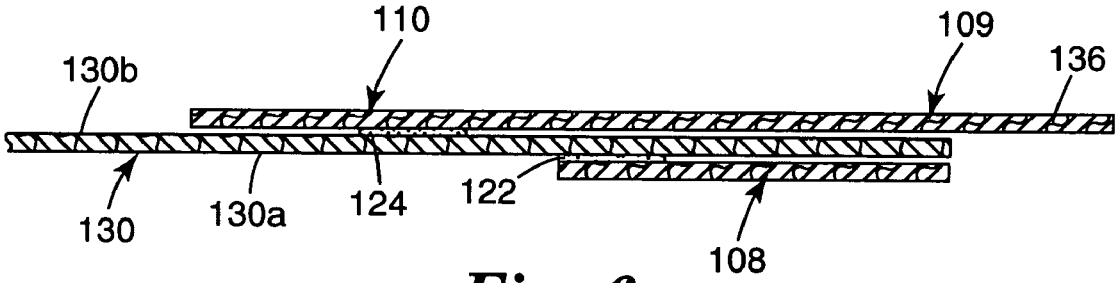
FIG. 6 is a sectional view through line 6—6 of FIG. 4.

FIG. 6 is a sectional view of the tab 100 engaged with a sheet of paper 130 through line 6—6 of FIG. 4. As can be seen, when the upper portion 108 is folded over, the first adhesive strip 122 on the upper portion 108 contacts the first side 130*a* of the sheet of paper 130. The second adhesive strip 124 on the lower portion 110 contacts the second side 130*b* of the sheet of paper 130. The adhesive contact on opposite sides of the sheet of paper 130 firmly and positively secures the sheet of paper 130 within the tab 100.

Figure 7:
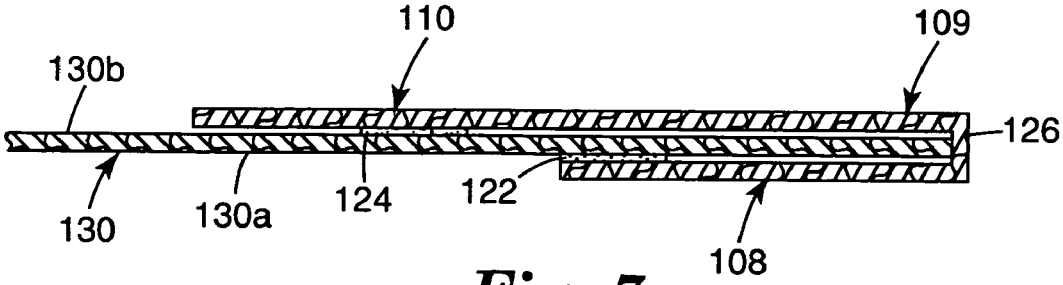
FIG. 7 is a sectional view through line 7—7 of FIG. 4.

FIG. 7 is a sectional view of the tab 100 engaged with a sheet of paper 130 through line 7—7 of FIG. 4. The top edge 132 of the sheet of paper 130 abuts against the fold-line 126 on each side of the flap 114 so that the position of the tab 136 is fixed relative to the top edge 132 of the sheet of paper 130. Consistent positioning relative to the top edge 132 of the sheet of paper 130 gives a consistent and uniform appearance to the tab extension 136.

The tab 100 shown in FIGS. 1–7 is overall generally rectangular shaped and symmetrical about the longitudinal axis 112, with a generally inverted U-shaped cut 120. A larger tab 100 is useful so that the surface of the front side 104 of the substrate 102 while attached to a sheet of paper 130, as shown in FIG. 4, becomes a writing surface for making notes or other markings. Additionally, the tab 100 may bear pre-printed indicia on one or more portions thereof, including the tab extension 136. The tab 100 may be any other size, shape, or color. The tab extension 136 may be a different color than the remainder of the tab 100. Further, any size or shape of cut 120 may be used. To achieve proper alignment relative to a sheet of paper, a line passing through the first end 121 and second end 123 of the cut 120 should be perpendicular to the longitudinal axis 112 of the tab 100.

When repositionable adhesive is used for first and second adhesive strips 122 and 124, the tab 100 provides a tab that can be positioned on a sheet of paper and then removed and repositioned on a different sheet of paper. The "repositionable" tab 100 may provide a traditionally shaped rectangular tab along the top edge of a sheet of paper that is properly aligned with the top of the sheet of paper to give the tab a uniform and professional appearance (so long as the top edge of the sheet of paper abuts the fold-lines).

Further, the tab 100 may be of different shapes and sizes and may be positioned at a corner or bottom of a sheet of paper. The tab 100 may be large enough such that a writing surface is provided which gives an area for making notes relating to the flagged page without marking directly on the flagged page.

"Repositionable" tabs 100 may be packaged such that they are stacked on one another with the adhesive strips on the back side 106 adhering to the front side 104 of the next repositionable tab 100 similar to a pad of Post-it® brand notes available from 3M Company of St. Paul, Minn.

Further, repositionable tabs 100 may be provided on a continuous liner with the adhesive strips facing the liner.

Although the present invention has been described with reference to preferred embodiments, workers skilled in the art will recognize that changes may be made in form and detail without departing from the spirit and scope of the invention.

What is claimed is:

1. A tab for attaching to sheet material, the tab comprising:

a substrate including a front side and a back side opposite the front side, the substrate further including an upper portion, a middle portion, and a lower portion, wherein corners of the upper portion are shaped differently from corners of the lower portion, the differently shaped corners providing at least one of a visual signal and a tactile signal to a user to distinguish the upper portion from the bottom portion of the tab;

a cut through the middle portion of the substrate to form a flap;

an adhesive along the upper portion of the back side and along the lower portion of the back side of the substrate, wherein the middle portion is free of adhesive; and a fold-line through the middle portion which allows the substrate to be folded, wherein when the substrate is folded along the fold-line the flap extends beyond the fold-line and the back side of the upper portion faces the back side of the middle portion.

2. The tab of claim 1, wherein the sheet material is positioned against the fold-line and between the back side of the lower portion and the back side of the upper portion such that the flap extends beyond the sheet of paper.

3. The tab of claim 2, wherein the adhesive along the upper portion of the back side and along the lower portion of the back side adheres to the sheet material.

4. The tab of claim 1, wherein the cut is symmetrical across a longitudinal axis passing through the upper, middle, and lower portion.

5. The tab of claim 4, wherein the cut is generally an inverted U-shape.

6. The tab of claim 1, wherein the cut further comprises a first end and a second end, wherein the fold-line is adjacent to the first end and the second end of the cut.

7. The tab of claim 1, wherein the adhesive is a repositionable adhesive.

8. A tab for attaching to sheet material, the tab comprising:

a substrate including a front side and a back side opposite the front side, the substrate further including a longitudinal axis passing through an upper portion, a middle portion, and a lower portion of the substrate, wherein corners of the upper portion are shaped differently from corners of the lower portion, the differently shaped corners providing at least one of a visual signal and a tactile signal to a user to distinguish the upper portion from the bottom portion of the tab;

a cut through the middle portion of the substrate including a first end and a second end to form a flap, wherein a line through the first end and second end is perpendicular to the longitudinal axis;

adhesive along the upper portion of the back side and along the lower portion of the back side of the substrate, wherein the middle portion is free of adhesive; and a fold-line through the middle portion and passing along the line through the first end and second end of the cut, wherein when the substrate is folded along the fold-line the flap extends beyond the fold-line and the back side of the upper portion faces the back side of the middle portion.

9. The tab of claim 8, wherein the sheet material is positioned against the fold-line and between the back side of the lower portion and the back side of the upper portion such that the flap extends beyond the sheet material.

10. The tab of claim 9, wherein the adhesive along the upper portion of the back side adheres to a first side of the sheet of paper and the adhesive along the lower portion of the back side of the substrate adheres to a second side of the sheet material.

11. The tab of claim 8, wherein the cut is generally an inverted U-shape.

12. The tab of claim 8, wherein the flap is generally symmetrical across the longitudinal axis.

13. The tab of claim 8, further comprising:

an edge of the flap;

a first distance from the first end of the cut to the edge of the flap;

a second distance from the second end of the cut to the edge of the flap;

wherein the first distance equals the second distance.

14. The tab of claim 8, wherein the adhesive is a repositionable adhesive.

15. A tab for attaching to sheet material, the repositionable tab comprising:

a substrate including a first face and a second face opposite the first face, the substrate further including a longitudinal axis passing through an upper portion, a middle portion, and a lower portion of the substrate, wherein corners of the upper portion are shaped differently from corners of the lower portion, the differently shaped corners providing at least one of a visual signal and a tactile signal to a user to distinguish the upper portion from the bottom portion of the tab;

a cut through the middle portion of the substrate having a first end and a second end, the cut defines a tongue having an edge and a length parallel to the longitudinal axis, wherein the length of the tongue on each side of the longitudinal axis is equal;

adhesive along the upper portion of the second face of the substrate and along the lower portion of the second face of the substrate, wherein the middle portion is free of adhesive; and a fold-line through the middle portion, adjacent to the first and second end of the cut, and perpendicular to the longitudinal axis, wherein when the substrate is folded along the fold-line the flap extends beyond the fold-line and the second face of the upper portion faces the second face of the middle portion.

16. The tab of claim 15, wherein the sheet material is positioned against the fold-line and between the back side of the lower portion and the back side of the upper portion such that the flap extends beyond the sheet of paper.

17. The tab of claim 15, further comprising a line passing through the first end and the second end of the cut which is perpendicular to the longitudinal axis.

18. The tab of claim 17, wherein the fold-line passes along the line passing through the first end and the second end of the cut.

19. The tab of claim 15, wherein the cut is generally an inverted U-shape.

20. The tab of claim 15, wherein the adhesive is a repositionable adhesive.

* * * * *

UNITED STATES PATENT AND TRADEMARK OFFICE

CERTIFICATE OF CORRECTION

PATENT NO. : 7,225,570 B2
APPLICATION NO. : 10/884046
DATED : June 5, 2007
INVENTOR(S) : David C. Windorski It is certified that error appears in the above-identified patent and that said Letters Patent is hereby corrected as shown below:

Title Page
Column 1, line 4, under "U.S. Patent Documents" delete "3,458,948" and insert --3,458,946--, therefor.

Column 2
Line 46, after "upper" delete "potion" and insert --portion--, therefor.

Column 3
Line 3, Delete "Post-its" and insert -- Post-it® --, therefor.

Signed and Sealed this

Twenty-seventh Day of November, 2007

JON W. DUDAS
*Director of the United States Patent and Trademark Office*